US007475789B2

(12) United States Patent
Fischer

(10) Patent No.: US 7,475,789 B2
(45) Date of Patent: Jan. 13, 2009

(54) BUCKET WITH A LID HAVING A PIVOTING TAB

(75) Inventor: Ronald Fischer, Montabaur (DE)

(73) Assignee: Jokey Plastik Wipperfurth GmbH, Wippwefurth (DE)

( * ) Notice: Subject to any disclaimer, the term of this patent is extended or adjusted under 35 U.S.C. 154(b) by 529 days.

(21) Appl. No.: 10/522,641

(22) PCT Filed: Jul. 18, 2003

(86) PCT No.: PCT/EP03/07847

§ 371 (c)(1),
(2), (4) Date: Jan. 26, 2005

(87) PCT Pub. No.: WO2004/013013

PCT Pub. Date: Feb. 12, 2004

(65) Prior Publication Data

US 2006/0060583 A1 Mar. 23, 2006

(30) Foreign Application Priority Data

Jul. 26, 2002 (DE) ..... 202 11 866 U
Dec. 3, 2002 (DE) ..... 202 19 271 U

(51) Int. Cl.
*B65D 17/52* (2006.01)
*B65D 17/32* (2006.01)
*B65D 41/18* (2006.01)

(52) U.S. Cl. ..... 220/285; 220/268; 220/780

(58) Field of Classification Search ..... 220/268, 220/780, 285, 802, 805; 215/305; 81/3.27, 81/3.35

See application file for complete search history.

(56) References Cited

U.S. PATENT DOCUMENTS

| | | | | |
|---|---|---|---|---|
| 2,223,695 | A * | 12/1940 | Mayfield | 220/285 |
| 2,334,225 | A | 11/1943 | Socke | |
| 2,837,263 | A | 6/1958 | Nasello | |
| 3,587,654 | A | 6/1971 | Yocum | 138/96 |
| 3,753,512 | A | 8/1973 | Curry | 220/43 R |
| 4,116,362 | A | 9/1978 | Skinner | 220/284 |
| 2002/0125250 | A1 * | 9/2002 | Fang | 220/266 |

FOREIGN PATENT DOCUMENTS

| | | |
|---|---|---|
| AT | 101132 | 9/1925 |
| DE | 228115 | 12/1909 |

(Continued)

*Primary Examiner*—Robin Hylton
(74) *Attorney, Agent, or Firm*—Grossman Tucker Perreault & Pfleger, PLLC

(57) ABSTRACT

There is described a bucket with a lid whose circumferential rim formed thereon can be latchingly connected to an outwardly projecting circumferential flange formed on the edge of the vessel body, in such a way that in the latching position the free end edge of the circumferential lid rim is covered by a region of the vessel circumferential flange, and with a tab which serves for unlatching lifting of the lid in a partial circumferential region and which is arranged in the course of the vessel circumferential flange and interrupts same and is pivotable relative thereto in such a way that its edge remote from the pivot axis moves away from the vessel body out of its locking position in which it is aligned with the vessel circumferential flange and which corresponds to the lid latching position into its lid lift-off position.

30 Claims, 11 Drawing Sheets

FOREIGN PATENT DOCUMENTS

Figure 1:
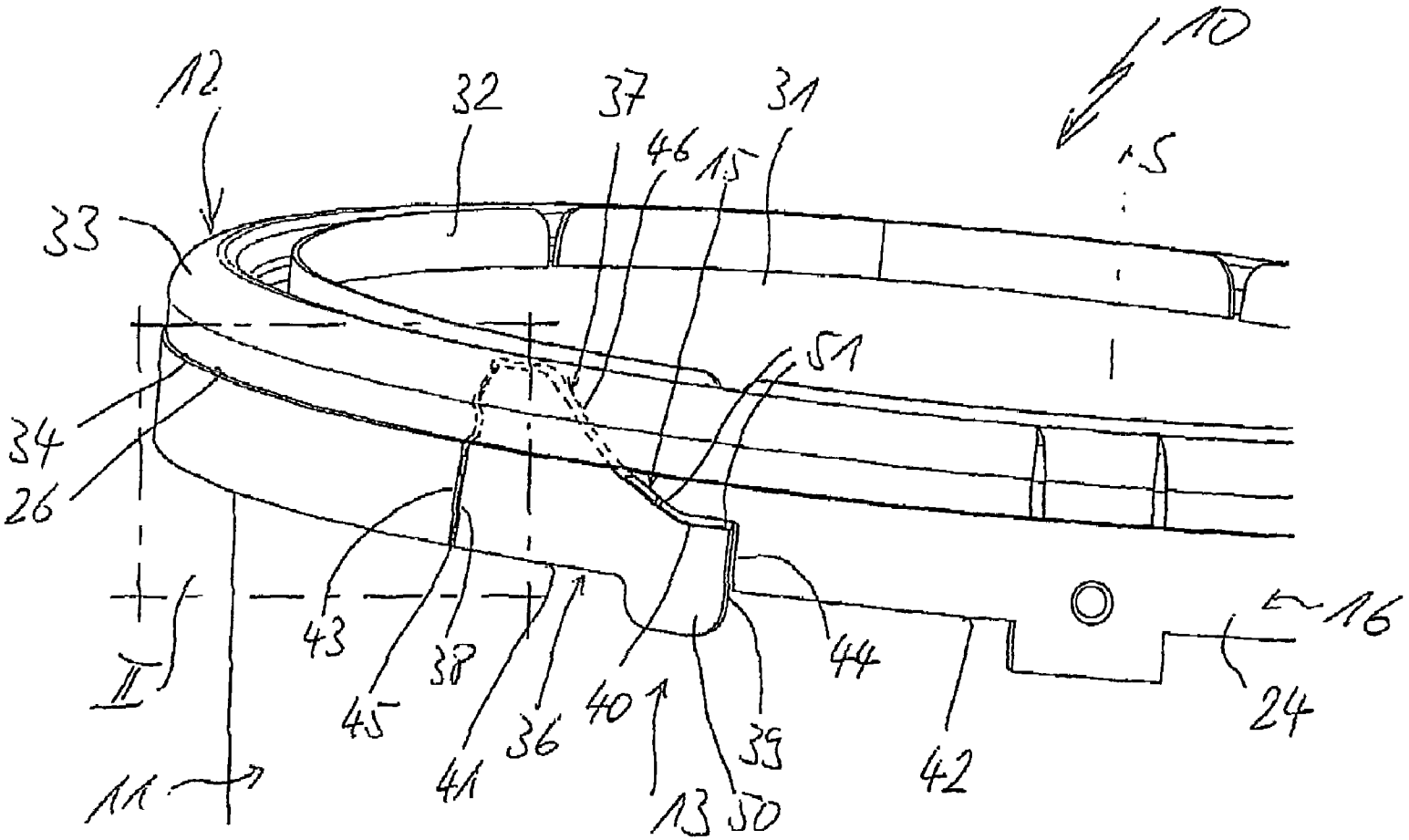

| | | |
|---|---|---|
| DE | 1 052 177 | 11/1954 |
| DE | 1 097 895 | 1/1961 |
| DE | 10 97 895 | 1/1961 |
| DE | 92 05 256 | 6/1992 |
| EP | 0 565 967 | 10/1993 |
| FR | 11 71 292 | 1/1959 |

* cited by examiner

BUCKET WITH A LID HAVING A PIVOTING TAB

DESCRIPTION

The invention relates to a pot-shaped vessel, in particular a bucket, with a lid, as set forth in the classifying portion of claim 1.

In the case of a pot-shaped vessel of that kind which is known from EP 0 565 967 B2, the tab which serves for unlatchingly lifting the lid is held pivotably in parallel relationship with the circumferential direction on a horizontal pivot axis on the vessel circumferential flange. In other words, the pivot axis extends parallel to the lower free edge of the tab, which free edge is in alignment with the lower free circumferential edge of the vessel circumferential flange. An outwardly facing surface region of the tab acts as an operative surface for unlatchingly lifting the lid. In order to provide a suitable lever arm length for the tab in the case of that known pot-shaped vessel, the tab must project a distance beyond the lower edge of the vessel circumferential flange. Nonetheless, unlatchingly lifting the lid with that tab which pivots outwardly and towards the lid is relatively abrupt or jerky. In addition, with that kind of opening movement, the person using the arrangement is inclined to place the thumb on the lid when using the fingers to engage behind the tab, and the thumb then acts in opposition to the unlatching lifting movement of the lid.

The object of the present invention is to provide a pot-shaped vessel, in particular a bucket, having a lid, of the kind set forth in the opening part of this specification, whose opening mechanism permits more convenient handling and with which a more steady unlatching lifting movement of the lid is achieved.

In the case of a pot-shaped vessel, in particular a bucket, with a lid, of the kind set forth in the opening part of this specification, that object is attained by the present invention.

The measures according to the invention provide that the length of the lever arm for opening the lid with the application of less force is possible by increasing the length of the tab in the peripheral direction, which does not cause any problem, so that the tab does not necessarily have to project downwardly beyond the vessel circumferential flange. A corresponding configuration of the cam track means that it is possible to achieve a steady and thus sensitive unlatching lifting movement of the lid. The movements involved do not require any counteracting pressure to be applied to the lid but at most against the wall of the vessel body.

The pivot axis of the tab can be precisely perpendicular and thus parallel to a notional axis of the vessel, or it can be inclined towards that axis of the vessel and/or in a notional X-Y-plane. The latter is advantageous in terms of promoting the unlatching lifting movement of the lid.

The present invention provides a pivot axis which is easy to produce.

Advantageous pivotal mountings of the tab on the vessel body are afforded in the form of a single-arm or double-arm lever arrangement.

The features of the present invention additionally advantageously provide a safeguard in respect of originality of the pot-shaped vessel, to indicate first opening of the vessel. The tab for latchingly lifting the lid can be provided with an originality or anti-tamper safeguard in the form of a film or legs which connect the tab to the vessel circumferential flange in integral relationship therewith and which tears or tear open when the tab is lifted for the first time. Such striking destruction of the anti-tamper arrangement can be afforded in the case of the pot-shaped vessel in accordance with another embodiment in a simple manner which is to be actuated in a less abrupt fashion. When such an anti-tamper or originality safeguard is involved, a connection which is integral in respect of the materials involved is not broken open, which naturally signifies the application of a corresponding amount of force and a jerky movement, but at the end of the lid lifting movement there will still remain a latching connection which is not reversible and which thus remains visible. In that respect the particularity lies in the sequence of movements of the tab and the latching loop or clip. The pivotal movement of the latching clip is derived from the pivoting movement of the tab in a steadily transmitting relationship. In this case the configuration of the latching clip is such that, at the beginning of its pivotal movement, it dives under the circumferential edge of the vessel circumferential flange. A latching means which is simple to produce is afforded by virtue of the fact that it is provided on an adjacent support leg for the vessel circumferential flange.

Figure 2:
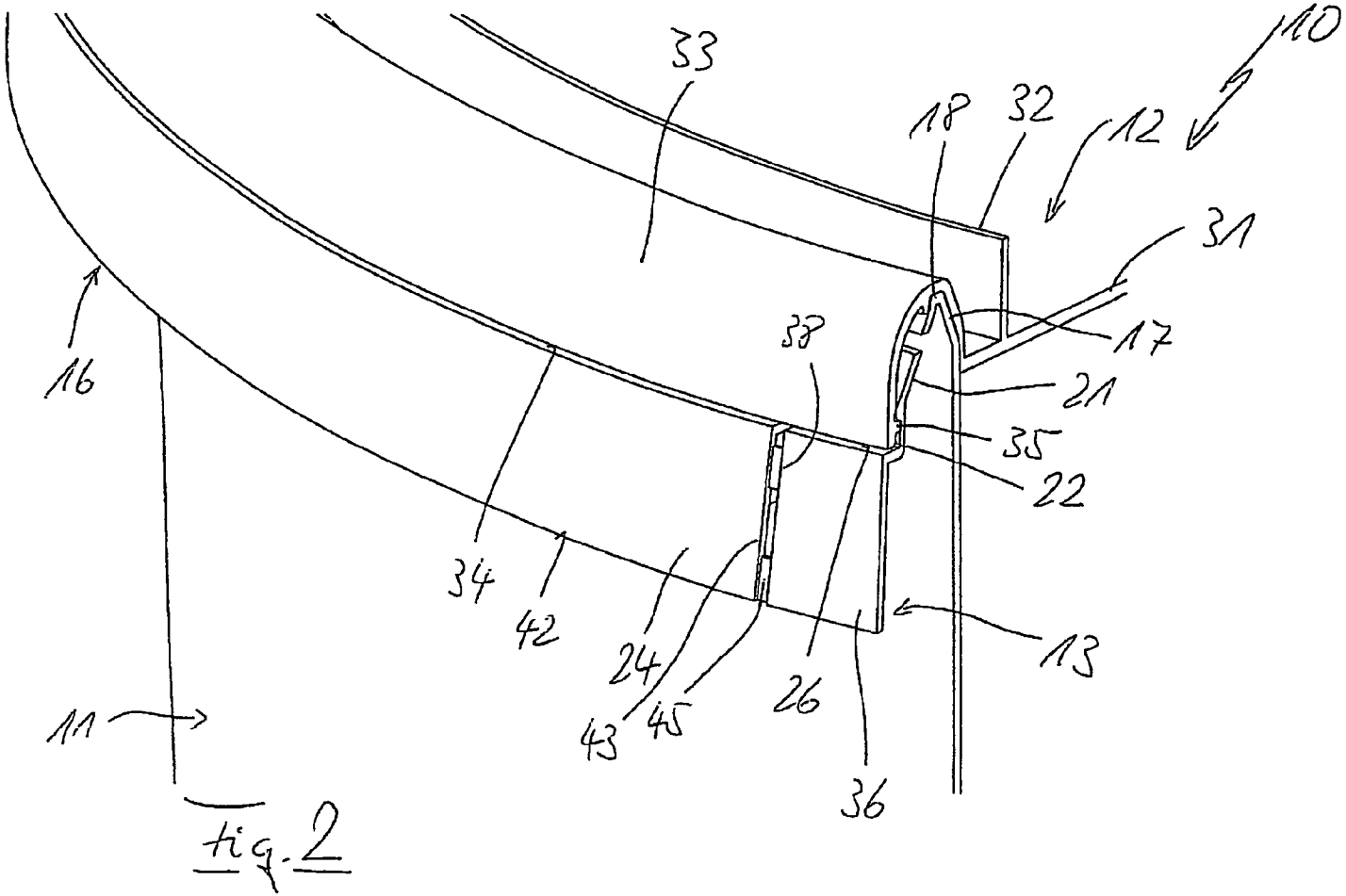
Figure 3:
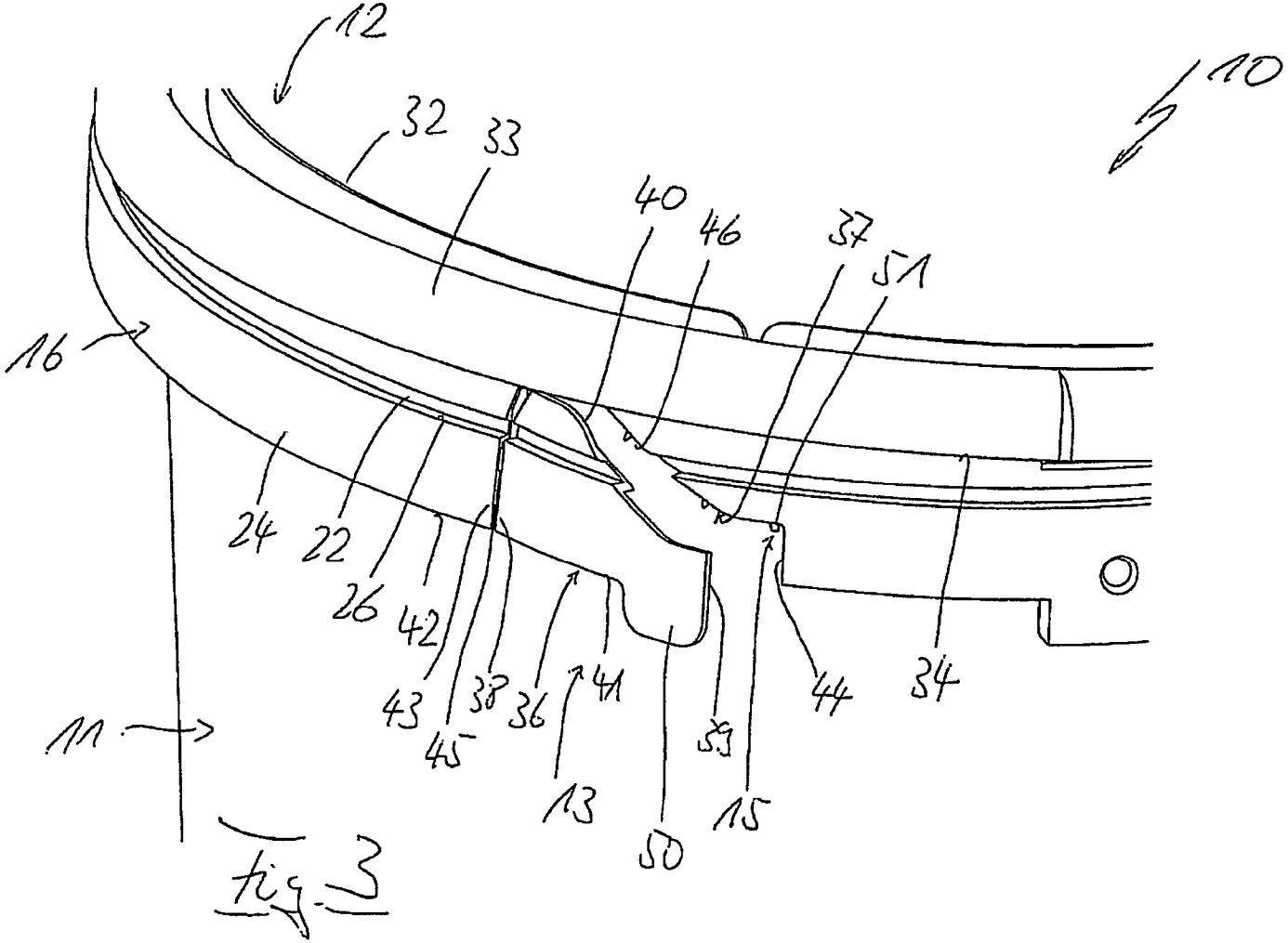
Figure 4:
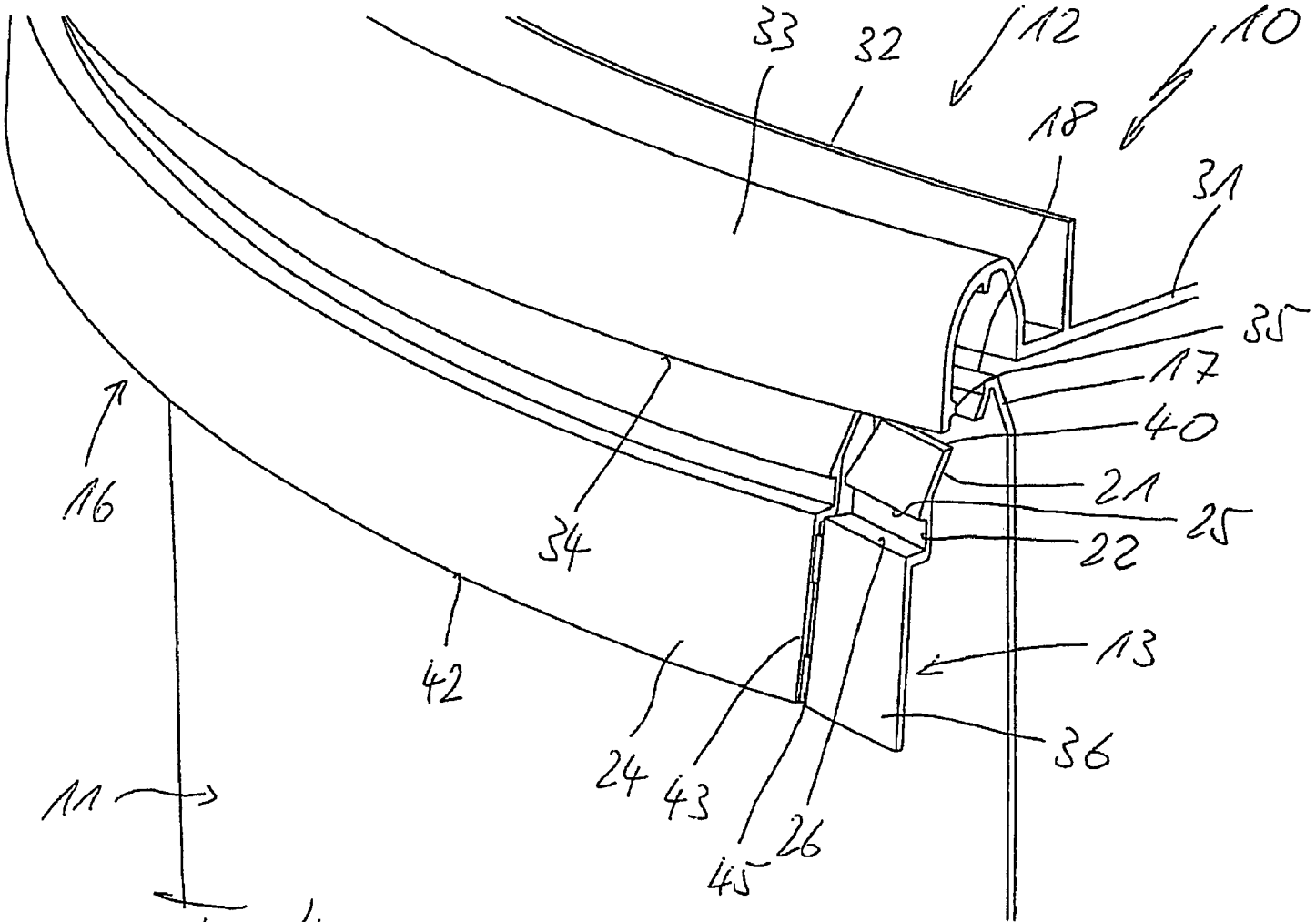
Figures 5A, 5B:
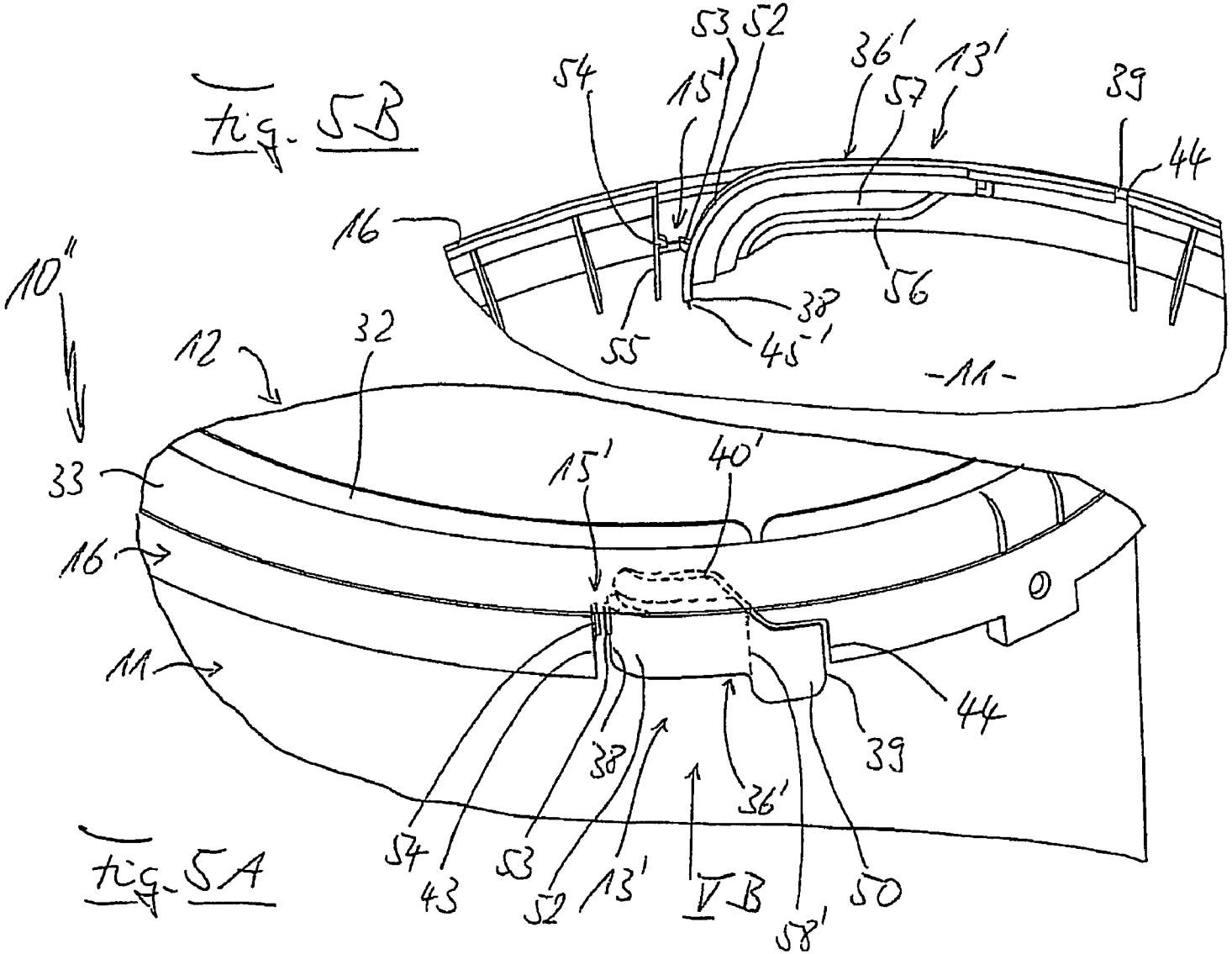
Figures 6A, 6B:
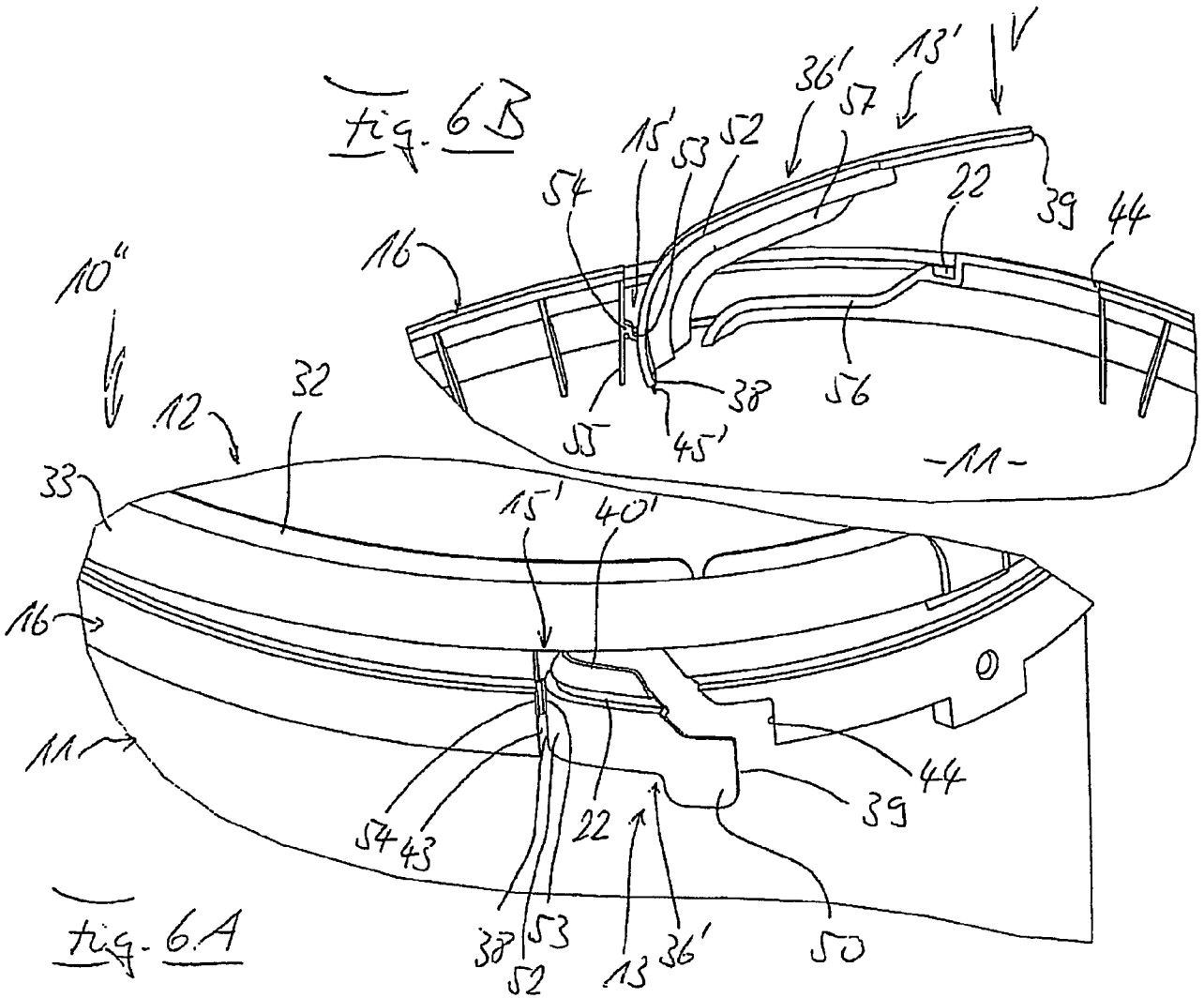
Figure 7:
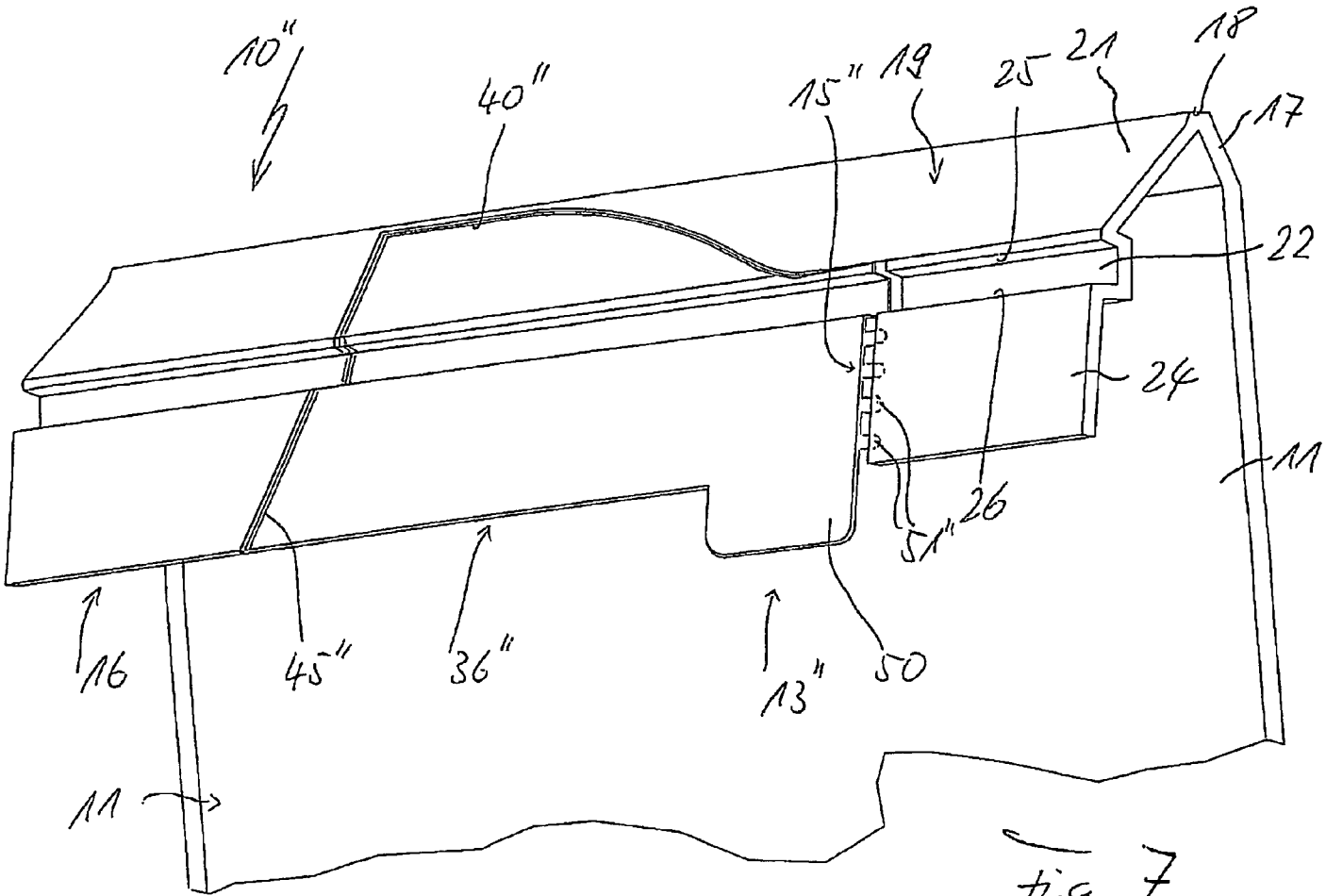
Figure 8:
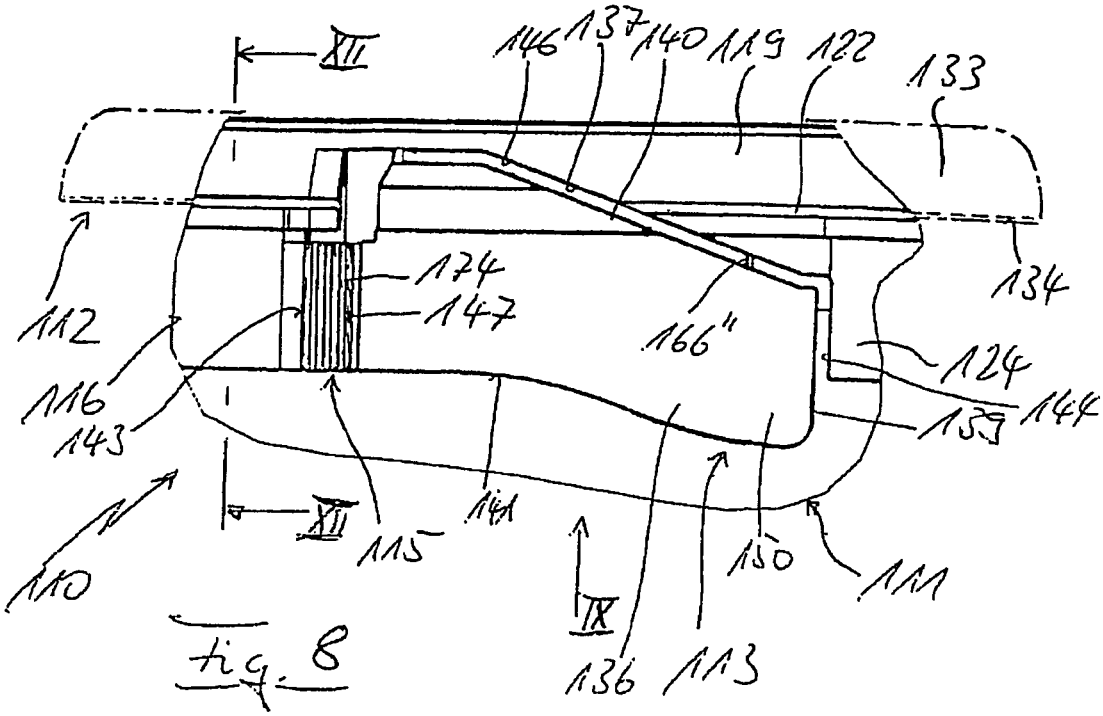
Figure 9:
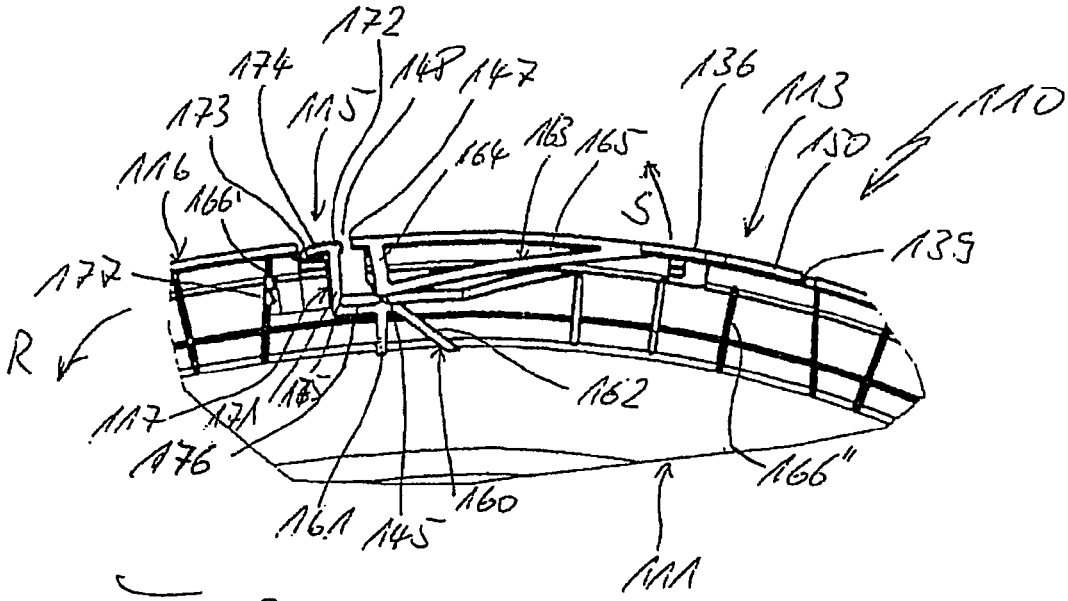
Figure 10A:
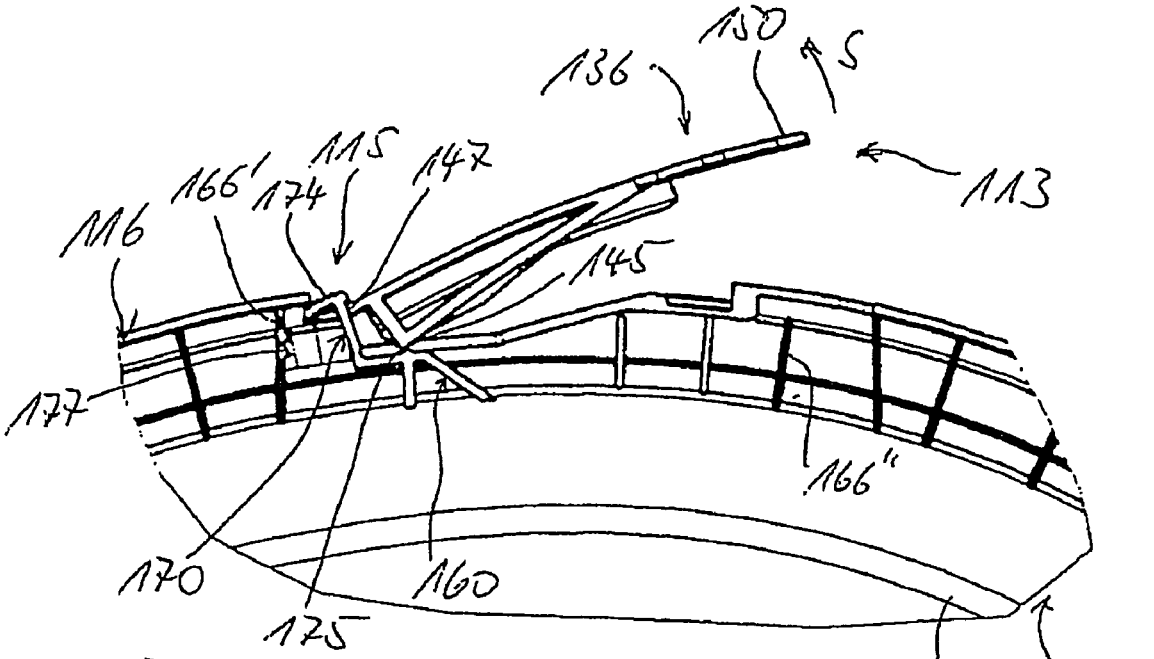
Figure 10B:
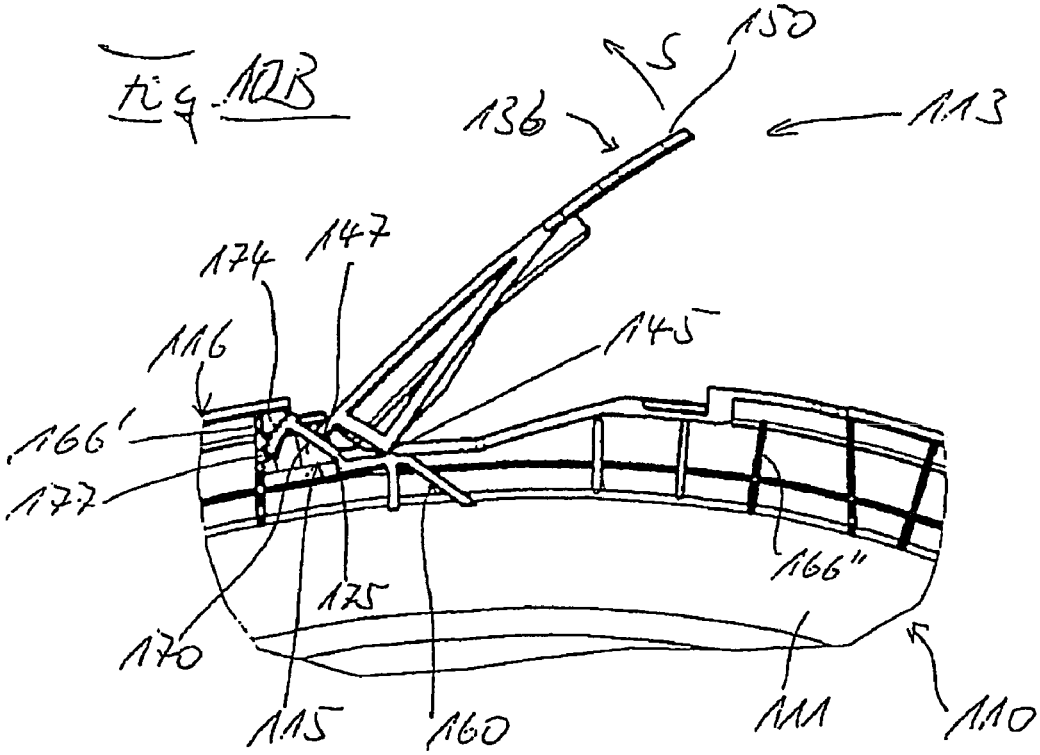
Figure 11:
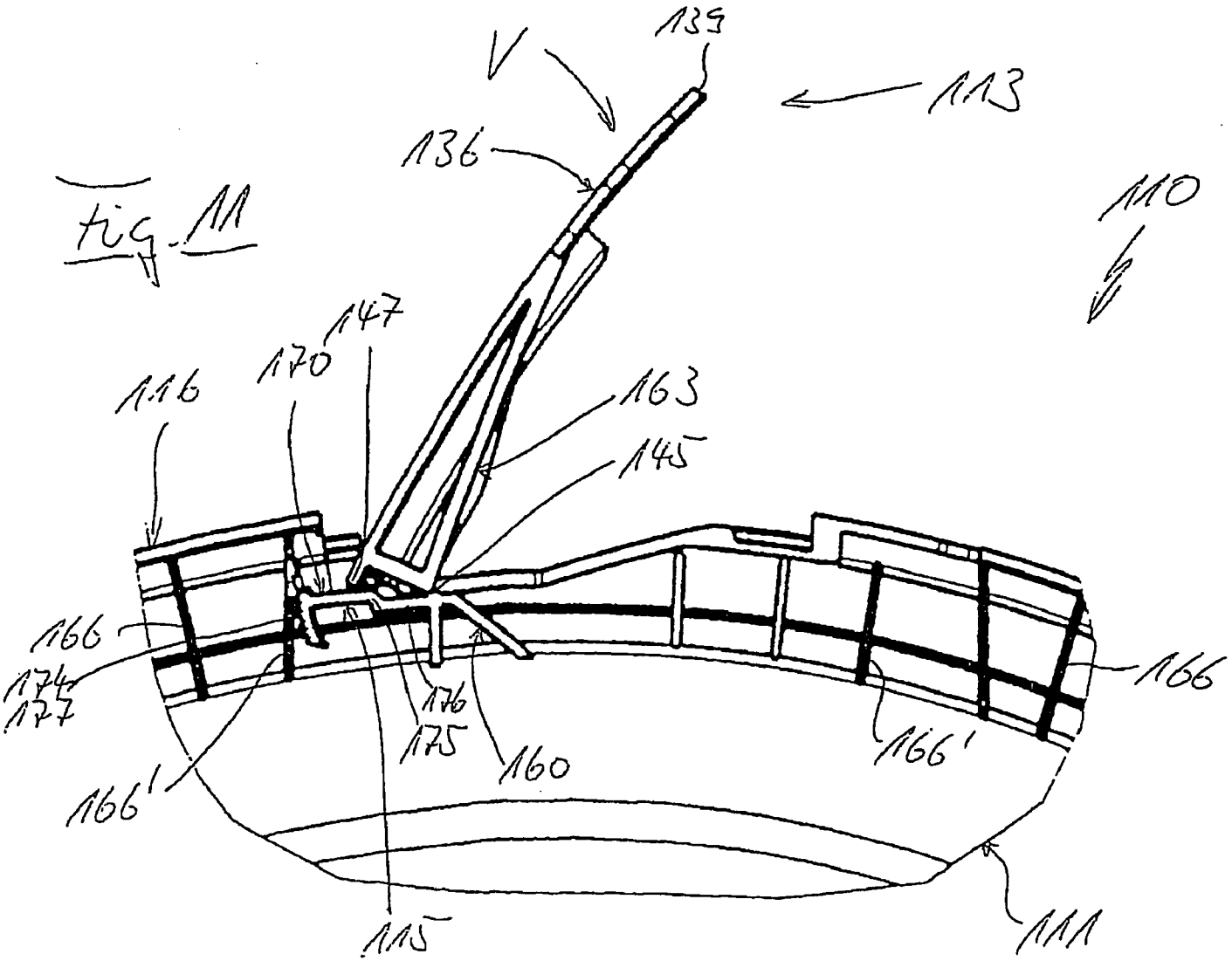
Figure 12:
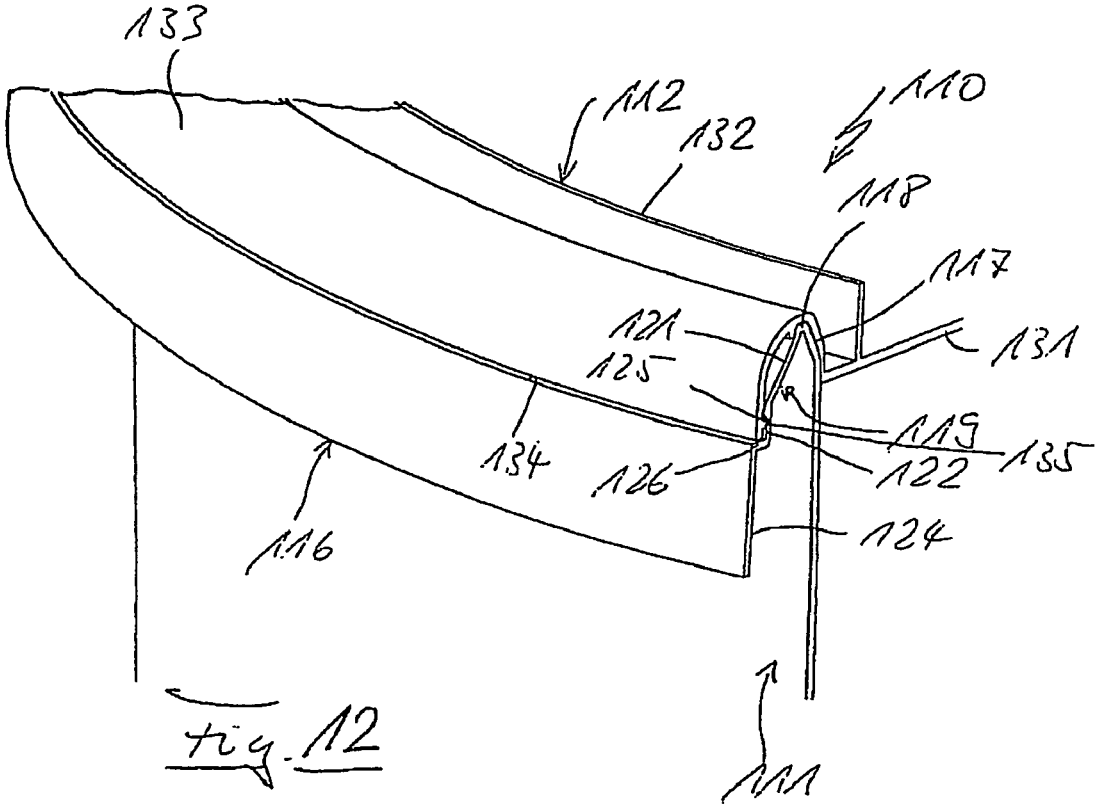
Figure 13:
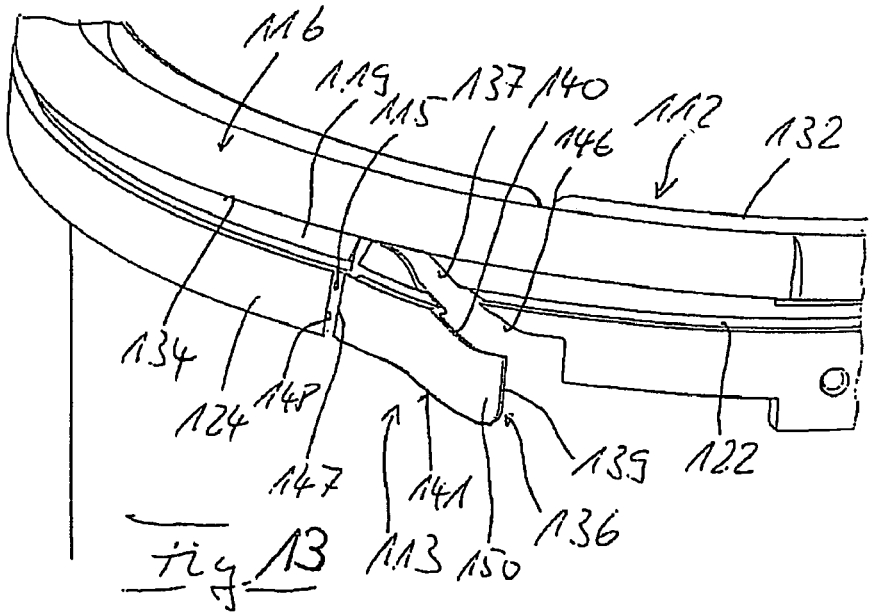

Further details of the invention are to be found in the description hereinafter in which the invention is described and explained in greater detail by means of the embodiments illustrated in the drawing in which:

FIG. 1 is a broken-away perspective view of a pot-shaped vessel in the form of a bucket provided with a lid in the closed condition in accordance with a first embodiment of the present invention, FIG. 2 is a view on an enlarged scale of a portion as indicated by the rectangle II-II in FIG. 1, FIG. 3 is a view corresponding to FIG. 1 but with the lid lifted off the bucket in the region of the opening assistance means, FIG. 4 is a view corresponding to FIG. 2 but in the FIG. 3 condition, FIGS. 5A and 5B are a view corresponding to FIG. 1 and a view from below as indicated by arrow VB but in accordance with a second embodiment, FIGS. 6A and 6B show views corresponding to FIGS. 5A and 5B but in the condition shown in FIG. 3, FIG. 7 shows a view on an enlarged scale of a portion of the structure similar to FIG. 2 but in accordance with a further variant of the first embodiment and without a lid, FIG. 8 is a broken-away side view of a pot-shaped vessel in the form of a bucket to be provided with a lid, with the opening tab closed and with the condition of the lid indicated laterally in dash-dotted line, in accordance with a third embodiment of the present invention, FIG. 9 is a view from below as indicated by arrow IX in FIG. 8, FIGS. 10A and 10B are views corresponding to FIG. 9 but in positions during the pivotal movement of the opening tab, FIG. 11 is a view corresponding to FIG. 9 but in the completely open position of the opening tab, FIG. 12 is a perspective view, broken-away along the line XII-XII in FIG. 1, of the bucket with the lid latched thereon, and FIG. 13 is a view corresponding to FIG. 1 but as a perspective view, with the lid lifted in accordance with the pivoted position of the tab, as shown in FIG. 11.

The vessel illustrated in FIGS. 1 through 7 in accordance with a first embodiment is a bucket 10, 10', 10" which is formed from plastic material and whose body 11 is covered by a lid 12 also formed from plastic material. As will be described hereinafter, the lid 12 is fitted in latching relationship on the body 11 in such a way that the lid 12 is only to be opened by an opening assistance means 13, 13' and 13" respectively, which is integrated on the bucket 10.

At its upper end which is remote from the bottom and which defines the opening of the bucket, the body 11 of the bucket 10, 10', 10" is integral with a circumferential flange 16 which is approximately roof-shaped in cross-section and which surrounds the outside of the body 11 at a spacing. The circumferential flange 16 has a narrow first roof portion 17 which is formed on the body 11 and whose ridge 18 which forms the support for the lid 12 is adjoined by a second wider roof portion 19. The second roof portion 19 has a flat surface portion 21 which is adjacent to the ridge 18 and which is separated from the lower free flange portion 24 by way of a groove 22 directed towards the body 11 (FIGS. 6B and 7). At the transition to the free flange portion 24 the groove 22 is deeper than at the transition to the flat surface portion 21. That configuration provides a support surface for the rim of the lid which is still to be described, on the portion of the lower inside wall 26, which projects with respect to the upper inside wall 25.

The lid 12 which is identical in all variants has a flat cover 31 which is provided at its top side with a perpendicularly projecting, substantially circumferentially extending centering rim 32. Provided at the outside circumference on the cover 31 is a lid circumferential rim 33 which is shaped at the inside to correspond to the bucket circumferential flange 16 and whose free lower edge 34, in the closed latched condition, rests on the support surface 26 in such a way that the outside surface regions of the lid circumferential rim 33 and the free flange portion 24 of the bucket circumferential flange 16 are aligned with each other. The lid circumferential flange 33 is also provided with an inner projecting circumferentially extending latching rib 35 which, in the closed latching condition of the lid 12, latches on the bucket 10, 10', 10" behind the upper inside wall 25, engaging into the groove 22 of the circumferential flange 16. As the lid 12 which is latched on the bucket 10, 10', 10" in that way cannot be lifted off the bucket body 11 without a tool, that is to say using the bare hands, the opening assistance means 13, 13', 13" is provided.

The opening assistance means 13 as shown in FIGS. 1 through 4 has a tab 36 which is arranged in the course of the second roof portion 19 of the circumferential flange 16. For that purpose the second roof portion 19 of the circumferential flange 16 is provided with a cut-out 37 in which the tab 36 is mounted pivotably at one end. The tab 36 in the cut-out 37 is delimited at the one circumferential end by a pivotal edge 38 and at the other circumferential end by a free edge 39, being defined in the circumferential direction towards the ridge 18 by a curved cam edge 40 and remote from the ridge 18 by a stepped lower edge 41 which, towards the pivotal edge 38, is aligned with the lower edge 42 of the circumferential flange 16 and projects at the other end. The pivotal edge 38 extends over a substantial region of the further roof portion 19 of the circumferential flange 16 to close to the ridge 18. The free edge 39 of the tab 36 extends in substantially parallel relationship with the pivotal edge 38 over a partial region of the free flange portion 24 and terminates in front of the groove 22 and outside the lid 12. The cam edge 40 which is of a given cam configuration that is still to be described, extends in the circumferential direction over the flat surface portion 21, the groove 22 and over a partial region of the free flange portion 24. The cut-out 37 in the circumferential flange 36 has a pivotal edge 43 which is parallel to the pivotal edge 38 of the tab 36 and, remote from the edge 43, a free edge 44 whose region which is disposed in the free flange portion 24 extends in parallel relationship with the free edge 39 of the tab 36. There is a narrow gap between the above-mentioned respective edges of the tab 36 and the circumferential flange 16. The tab pivotal edge 38 which faces towards the pivotal edge 43 at the periphery on the circumferential flange 16 is formed on the pivotal edge 43 by way of a film hinge 44 so that the tab 36 is pivotable about that pivot axis formed thereby. The cut-out 37 in the circumferential flange 16 can be rectangular. In the illustrated embodiments by way of example however the longitudinal edge 46 of the cut-out 37, which connects the edges 43 and 44, is designed to extend parallel to the cam edge 40 of the tab 36.

The curved cam edge 40 of the tab 36 is of a sinusoidal configuration in such a way that a convexly falling configuration which extends from the pivotal edge 38 or the film hinge 45 is adjoined by an oppositely directed concave configuration with a linear end to the free edge 39. The cam edge 40 in the first embodiment illustrated in FIGS. 1 through 4 and the second embodiment illustrated in FIGS. 5A, B and 6A, B is only partially covered by the lid circumferential rim 33, that is to say it is approximately one-third exposed at its end to be visible in the region of the free flange portion 24.

The function of the tab 36 as an opening assistance means 13 is operative such that the tab 36 is gripped at its free circumferential end, for example at a tab grip portion 50 which is increased in width or which projects below the lower edge 42 of the flange 16, and pivoted about the vertical pivot axis 45 outwardly, that is to say away from the bucket body 11. In that pivotal movement of the cam edge 47 in the outward direction, the lower edge 34 of the lid 12 is gripped so that, with the further pivotal movement of the tab 36, the lid 12 is moved outwardly by the outwardly moving and rising cam edge 47 and unclipped and lifted (FIG. 3). As soon as the lid 12 is lifted by the opening assistance means 13 in that region of the tab 36, it is possible to engage under the lid 12 at the lower edge 34 with the hand, and pull off the lid. By virtue of the elastic film hinge 45 the tab 36 moves back into its initial position again so that for example after the content of the bucket 10 has been used the lid 12 can also be latched on again.

In the illustrated embodiments by way of example or the variants thereof of the opening assistance means 13, 13' and 13" respectively provided on the body 11 of the bucket 10, 10' and 10" for the lid 12, there is further provided an originality or anti-tamper safeguard 15, 15' and 15" respectively, from which it is possible to see whether the opening assistance means 13, 13', 13" has or has not already been actuated at least once for lifting the lid 12 off the bucket body 11. In the first embodiment of FIGS. 1 through 5 the anti-tamper safeguard 15 is formed by tear-away legs 51 or a tear-away film which is or are provided between the cam edge 40 of the tab 36 and the longitudinal edge 46 of the cut-out 37. In that respect that anti-tamper safeguard 15 is provided in the region of the pivotal edge 38 and the longitudinal edge 46, which is visible below the lid 12 when latched on, at the free flange portion 24 of the circumferential flange 16. This means that, when the lid 12 is latchingly lifted for the first time, by pivotal movement of the tab 36 about its vertical pivot axis 45, the tear-away legs 51 or a tear-away film is damaged so that the fact that the vessel has been opened for the first time is apparent.

The second embodiment shown in FIGS. 5A, B and 6A, B differs from the first embodiment of FIGS. 1 through 4 in that the vertical pivot axis 45' is not provided in the region of the circumferential flange 16 but at the outside of the body 11 of the bucket 10. In other words, the tab 36' is pivotably held with its pivotal edge 38 by way of a film hinge 45 to the outside of the bucket body 11.

In this embodiment the tab 36' is provided between its pivotal edge 38 on the bucket body 11 and its free edge 39 or its gripping portion 50 with a curve portion 52 which extends approximately through 90°. As described in relation to the first embodiment the cam edge 40' extends from the free edge 39 by way of the flat longitudinal region and the curve region 52 of the tab 36' to the pivotal edge 38. In this case the curve configuration of the cam edge 40' approximately corresponds to that of the cam edge 40 of the tab 36 of the first embodiment. In that respect, upon actuation of the tab 36' of this opening, assistance means 13', the same latching and lifting movement of the lid takes place.

The opening assistance means 13' can be provided with an anti-tamper safeguard 15 used in the first embodiment of FIGS. 1 through 4, in the visible region between the tab 36' and the circumferential flange 16. In the second embodiment of FIGS. 5A, 5B and 6A and 6B, there is an anti-tamper safeguard 15' in the form of latching projections 53 and 54, of which the latching projection 53 is formed in projecting relationship from the curve region 52 of the tab 36 and of which the latching projection 54 is formed in projecting relationship on a leg 55 which is supported in that region of the circumferential flange 16, that is near the tab 36', towards the bucket body 11. The latching projections 53 and 54 are arranged in mutually opposite relationship and extend beneath the groove 22 or the latched-on lower edge 34 of the lid 12 visibly over a given region in respect of height of the tab 36' and the circumferential flange 16. The latching projections 53 and 54 are toothed at their mutually facing end faces in a manner not shown in detail here.

In the condition of the lid 12 in which it is latched on the bucket body 11, as shown in FIGS. 5A and 5B, the two latching projections 53 and 54, with their toothed end edges, are at a given spacing from each other. In the open condition of the tab 36' and the lifted condition of the lid 12, as shown in FIGS. 6A and 6B, the latching projection 53 has become non-releasably hooked or latched into the latching projection 54 of the circumferential flange 16 by virtue of the pivotal movement of the tab 36'. In other words, due to the mutual hooking or latching engagement of the two latching projections 53 and 54, the tab 36' remains in the pivotal position shown in FIGS. 6A and 6B or at any event in a pivoted open position indicating an opening movement for the first time, which advantageously involves a smaller angle of opening of the tab 36', than is indicated in FIGS. 6A and 6B in exaggerated form for the sake of clarity of the drawing. When the tab 36' is moved in the opposite direction to the opening movement, in the direction of the arrow V, at its gripping portion 50, towards the body 11, nonetheless the mutually hooked or latched condition is maintained by virtue of the elasticity of the two latching projections 53 and 54. This also means that that non-releasable connection of the two latching projections 53 and 54 is maintained when the lid 12 is again latched on to or over the circumferential flange 16 of the body 11, and thus the damage to the anti-tamper safeguard 15' remains visible. The lid 12 is latched in position again, as described above, either by simultaneously moving the tab 36' in the direction of the arrow V or by means of an inclined pass-over surface (not shown) at the cam edge 40' of the tab 36' for the region in question of the lid 12.

In accordance with a variant (not shown), the anti-tamper safeguard 15' in the second embodiment shown in FIGS. 5 and 6 can also be implemented if the elements shown therein in the form of latching projections 53 and 54 are in the form of deformation fingers which, in the original latching condition of the lid 12 on the body 11, overlap in such a way that the deformation finger of the tab 36', as seen from the outside of the bucket, is over the deformation finger on the circumferential flange 16. In the opening movement of the tab 36' corresponding to the view in FIG. 6 one of the deformation fingers is deformed in such a way that the overlap condition of the deformation fingers alternately changes, that is to say the deformation finger of the tab 36 now bears from the inside against the other deformation finger. That condition can no longer be changed in the return movement of the tab 36' as indicated by arrow V.

With the illustrated latching projections 53 and 54 and with the above-described deformation fingers which however are not shown, restoration of the destroyed anti-tamper safeguard 15' is prevented in the same manner in that the reverse movement of the tab 36', as indicated by the arrow V, is prevented by an abutment leg 56 which extends in curved projecting relationship from the bucket body 11 and against which the tab 36' comes to bear with its inner reinforcing legs 57.

In the variant shown in FIG. 7 the cam edge 40" of the tab 36" is only extended downwardly as far as the groove 22 in the circumferential flange 16, in other words the cam edge 40" is entirely within the lid 12 when latched on to the bucket body 11 and is thus not visible. The opening and lifting movement takes place in the same manner as, with the outward pivotal movement of the tab 36', there is also a downward movement at the same time by virtue of the elasticity, and that downward movement permits the cam edge 40" to engage under the lower edge 34 of the lid 12.

In the variant shown in FIG. 7 deformation legs 51" or a corresponding deformation film in addition thereto or instead thereof are provided as a connection between the free edge 39 of the tab 36" and the free edge 44 of the cut-out 37. The deformation legs or films are formed on an edge and, in the original non-tampered condition, engage behind the adjacent edge, out of which position they are advanced by deformation when the tab 36" is pivoted for the first time. Restoration of the deformation legs 51" or a deformation film is not possible by virtue of an abutment (not shown) for limiting a reverse movement in respect of the tab 36".

The variant shown in FIG. 7 also differs from the embodiments of FIGS. 1 through 4 and FIGS. 5 and 6 in the position of the pivot axis and thus the film hinge 45". While, in the above-mentioned embodiments, the pivot axis 45 extends substantially vertically, that is to say parallel to a notional axis of symmetry S (in the case of a cylindrical bucket, the axis of rotation), and the pivot axis 45, by virtue of the second roof portion 19 being inclined at an acute angle relative to the body 11, can be correspondingly inclined out of the X-Y-plane into the Y-Z-plane relative to the axis S, the variant shown in FIG. 7 provides that the pivot axis or the film hinge 45" is inclined at an angle in the X-Y-plane, that is to say it is arranged at an acute angle relative to the free edges 39, 44 which face away. That assists with lifting the lid 12 when the tab 36" is pivoted as the pivot axis 45" is inclined from below upwardly in a direction towards the free edge.

In the variant shown in FIG. 7 a safeguard film can be provided between the cam edge 40" which in itself is concealed and the longitudinal edge 46 if a viewing window is fitted into the lid circumferential rim 33.

An anti-tamper safeguard 15, 15' and 15" can also be implemented in such a way that the gripping portion 50 of the tab 36, 36' or 36" is provided at its region which goes into the main region of the tab with a weakening line 58' (only indicated in broken line in FIG. 5A) about which the gripping portion 50 is permanently bent over or bent away, prior to the actual opening movement of the tab 36, 36', 36". In that way destruction of the original condition is clearly apparent. In that situation the slightly bent gripping portion 50 does not prevent re-latching of the lid 12 on the bucket body 11. It will be appreciated that this can be provided instead of or in addition to the above-described anti-tamper safeguards.

A further variant of the second embodiment shown in FIGS. 5 and 6 provides that the tab 36' is designed to extend overall in the course of the free flange portion 24 of the circumferential flange 16 and in that case faces with its two free end edges 38, 39, separated by a gap, in opposite relationship to the free end edges 43, 44 of the circumferential flange 16. In that case in a region which is asymmetrical in the longitudinal direction and which is remote from the gripping portion 50 the tab 36' is integrally provided with an angularly projecting pivot leg whose end edge goes into the film hinge and in that way is pivotably connected to the bucket body 11. In that respect an anti-tamper safeguard 15, 15' or 15" can be provided in one of the above-described ways at the edge of the tab 36', which is remote from the gripping portion 50.

The circumferential dimension of the cut-out 37 and therewith the circumferential length of the tab 36, 36' or 36" depends on the desired factors of a lever arm which is operative when unlatchingly lifting the lid 12.

The vessel in accordance with a third embodiment as illustrated in FIGS. 8 to 13 is a bucket 110 which is made of plastic material and whose body 111 is covered by a lid 112 also made from plastic material. The lid 112 fits on the body 111 in latching relationship in such a way that the lid 112 is only to be opened with an opening assistance means 113 integrated on the bucket 110.

At its upper end which is remote from the bottom and which defines the opening of the bucket, the body 111 of the bucket 110 is integral with a circumferential flange 111 which is approximately roof-shaped in cross-section and which surrounds the outside of the body 111 at a spacing. The circumferential flange 111 has a narrow first roof portion 117 which is formed on the body 111 and whose ridge 118 which forms the support for the lid 112 is adjoined by a second wider roof portion 119. The second roof portion 119 has a flat surface portion 121 which is adjacent to the ridge 118 and which is separated from the lower free flange portion 124 by way of a groove 122 directed towards the body 111. At the transition to the free flange portion 124 the groove 122 is deeper than at the transition to the flat surface portion 121. That configuration provides a support surface for the rim of the lid which is still to be described, on the portion of the lower inside wall 126, which projects with respect to the upper inside wall 125. The lid 112 has a flat cover 131 which is provided at its top side with a perpendicularly projecting, substantially circumferentially extending centering rim 132. Provided at the outside circumference on the cover 131 is a lid circumferential rim 133 which is shaped at the inside to correspond to the bucket circumferential flange 116 and whose free lower edge 134, in the closed latched condition, rests on the support surface 126 in such a way that the outside surface regions of the lid circumferential rim 133 and the free flange portion 124 of the bucket circumferential flange 116 are aligned with each other.

The lid circumferential flange 133 is also provided with an inner projecting circumferentially extending latching rib 135 which, in the closed latching condition of the lid 112, latches on the bucket 110 behind the upper inside wall 125, engaging into the groove 122 of the circumferential flange 116. As the lid 112 which is latched on the bucket 110 in that way cannot be lifted off the bucket body 111 without a tool, that is to say using the bare hands, the opening assistance means 113 is provided.

The opening assistance means 113 has a tab 136 which is arranged in the course of the second roof portion 119 and the free flange portion 124 of the circumferential flange 116, the circumferential flange portions 119 and 124 being provided with a cut-out 137 in which the tab 136 is mounted pivotably near its one end. The tab 136 in the cut-out 137 is delimited at the one circumferential end by an actuating edge 147 and at the other circumferential end by a free edge 139, between which edges 147, 139 the one cam edge 140 which is towards the ridge 118 in the circumferential direction and, remote from the ridge 118, a stepped lower edge 141 which, towards the actuating edge 147, is aligned with the lower edge 142 of the circumferential flange 116 and projects at the other end. Left free between the actuating edge 147 of the tab 136 and the facing free edge 143 of the cut-out 137 of the circumferential flange 116 is a relatively wide gap 148 in which an anti-tamper safeguard 115 is arranged.

The actuating edge 147 of the tab 136 extends over a substantial region of the circumferential flange 116 to close to the ridge 118 but is disengaged in the further roof portion 119. The free edge 139 of the tab 136 extends in substantially parallel relationship with the pivotal edge 138 over a partial region of the free flange portion 124 and terminates in front of the groove 122 and outside the latched lid 112. The cam edge 140 which is of a given cam configuration that is still to be described, extends in the circumferential direction over the flat surface portion 121, the groove 122 and over a partial region of the free flange portion 124. The cut-out 137 in the circumferential flange 116 has the free edge 143 which is parallel to the actuating edge 138 of the tab 136 and, remote from the edge 143, a free edge 144 whose region which is disposed in the free flange portion 124 extends in parallel relationship with the free edge 139 of the tab 136. There is a narrow gap between the latter two edges 144 and 139. The cut-out 137 in the circumferential flange 116 can be rectangular. In the illustrated third embodiment however the longitudinal edge 146 of the cut-out 137, which connects the edges 143 and 144, is arranged to extend parallel to the cam edge 140 of the tab 136.

The curved cam edge 140 of the tab 136 is of a polygonal configuration in such a way that a substantially horizontal portion which extends from the set-back region of the actuating edge 147 is adjoined by a linearly falling portion and a substantially horizontal portion in turn adjoins same to the free edge 139. In the illustrated embodiment the cam edge 140 which can also extend sinusoidally is only partially covered by the lid circumferential rim 133, that is to say it is approximately one-third exposed at its end to be visible in the region of the free flange portion 124.

As can be seen in particular from FIG. 9 the tab 136 is pivotable by way of a pivot axis which is in the form of a film hinge 145 and which extends parallel to the free edges 139, 143 of the circumferential flange 116 and the tab 136 and in a plane between the circumferential surface of the tab 136 and the circumferential surface of the bucket body 110. Provided for that purpose is a mounting support 160 which is shaped at the peripheral side of the bucket body 111 and which is composed of legs 161 and 162 which converge towards each other in a trapezoidal fashion in a view from below and which extend substantially over the entire height of the circumferential flange 116. The film hinge 145 is provided in the region in which the two legs 161 and 162 converge. The inside of the tab 136 is provided with a support portion 163 which is approximately triangular in a view from below and which is formed by legs 164, 165 which converge towards each other in a triangular configuration and which are formed on the tab 136 and of which the one leg 165 is relatively long. That stiffening portion 163 is connected at its edge which accommodates the converging legs 164 and 165 and which extends substantially over the entire height of the tab 136, to the film hinge 145. Facing away from the free edge 139 of the tab 136 the connection of the mounting support 160 and the stiffening portion 163 by means of the film hinge 145 is such that the actuating edge 147 projects beyond the circumferential plane of the film hinge 145 so that the tab 136 has a very short actuating lever as far as the actuating edge 147 and a very long gripping lever as far as and including the free edge 139. In its gripping portion 150 towards the free edge 139 the tab 136 is supported at its inside by a short support leg 166" which projects from the periphery of the bucket body 111 and which is formed thereon so that the tab 136 is disposed in the circumferentially extending plane of the circumferential flange 116 in the rest position.

The function of the tab 136 as an opening assistance means 113 is operative such that the tab 136 is gripped at its free circumferential end, for example at the tab gripping portion 150 which is increased in width or which projects below the lower edge 142 of the flange 116, and pivoted about the vertical pivot axis 145 outwardly, that is to say away from the bucket body 111. In that pivotal movement of the cam edge 147 in the outward direction, the lower edge 134 of the lid 112 is gripped so that, with the further pivotal movement of the tab 136, the lid 112 is moved outwardly by the outwardly moving and rising cam edge 147 and unclipped and lifted (FIG. 12). As soon as the lid 112 is lifted by the opening assistance means 113 in that region of the tab 136, it is possible, with the tab opened, to engage under the lid 112 at the lower edge 134 with the hand, and pull off the lid. By virtue of the elastic film hinge 145 the tab 136 moves back into its initial position again so that for example after the content of the bucket 110 has been partially used the lid 112 can also be latched on again.

Provided in the movemental connection to the opening assistance means 113 provided on the body 111 of the bucket 110, for the lid 112, in the form of the tab 136, is the above-mentioned originality or anti-tamper safeguard 115 which, after assuming its latching position, reveals whether or that the opening assistance means 113 has or has not already been actuated at least once for lifting the lid 112 of the bucket body 111.

In the third embodiment that anti-tamper safeguard 115 is formed by a pivotable latching loop or clip 116 arranged in the gap 148 between the edge 143 of the circumferential flange 116 and the facing actuating edge 147 of the tab 136. The latching clip 170 which extends substantially over the height of the free flange portion 124 of the circumferential flange 116 is of a substantially hammer-shaped or T-shaped configuration as viewed from below. The latching clip 170 thus has a base leg 171 whose free end is connected to a stationary mounting leg 176 by way of a pivot axis in the form of a film hinge 165, the mounting leg 176 projecting from the mounting support 160 in the circumferential direction of the bucket. In that way the two pivot axes 145 and 175 are arranged to extend parallel in approximately one circumferential plane. Remote from the film hinge 175 the base leg 171 is covered by two mutually connected clip limbs 172 and 173 which extend in a curve in a plane. The clip limb 172 towards the actuating edge 147 of the tab 136 is relatively short while the clip limb 173 towards the circumferential flange 116 is relatively long in comparison. The length of the two limbs 172 and 173 in the circumferential direction is less than the internal width of the gap 148. At the external circumference the limbs 172 and 173 are provided with latching ribs 174 which extend in the direction of the edges 143 and 147 in question. The height of the base leg 171 of the pivotable latching clip 170 is such that, upon a pivotal movement of the clip 170 in the direction of the arrow R the free edge of the longer limb 173 dips under the free edge 143 of the cut-out 137 or the circumferential flange 116. The circumferential flange 116 is provided over its entire circumference at a substantially constant spacing with the above-mentioned support legs 166 of which the leg 166' that is towards the clip 170 is provided at its surface towards the clip 170 with here two parallel counterpart latching ribs 177 which, in the pivoted condition of the tab 136 shown in FIG. 11, provide for latchingly holding the clip 170 in that position.

The anti-tamper safeguard 115 acts in such a way as is apparent from the respective positions of the tab 136 and the latching clip 117 in FIGS. 10 and 11. When the tab 136 is moved from the starting or closed position in FIG. 9 in the direction of the arrow S the actuating edge 147 of the tab 136 as shown in FIG. 10 engages the latching clip 170, initially at the short limb 172 and then at the facing surface of the base leg 171, and moves the clip 170 in the pivotal direction indicated by the arrow R under the circumferential flange 116 to the adjacent support leg 166'. Upon further pivotal movement of the tab 136, which involves a lifting movement of the lid 112, the latching clip 170 with its latching ribs 174 comes into latching relationship with the counterpart latching ribs 177 on the support leg 166'. The latching clip 170 remains in that latching position of being pivoted through between 45° and 90° even when the tab 136 is moved back out of its position shown in FIG. 11 in the direction of the arrow V into the initial position shown in FIG. 9 or is automatically moved back by virtue of the flexibility of the film hinge 145, in which return position which is possibly even only near to the initial position, the lid 112 can be fitted on again in latching relationship and can be latched in position by way of the tab 136. The fact that the vessel has been opened for the first time can be clearly appreciated by virtue of the remaining latching position of the clip 170.

The invention claimed is:

1. A pot-shaped vessel, comprising;

a bucket body including an edge having an outwardly projecting circumferential flange formed thereon and a lid having a circumferential rim formed thereon, said rim including a free end edge, said lid latchingly connected to said outwardly projecting circumferential flange such that in a latching position said free end edge of the circumferential lid rim is covered by a region of said bucket body circumferential flange, and a tab having a pivot axis, an inner longitudinal edge and an edge remote from said pivot axis, said tab which serves for unlatching lifting of said lid in a partial circumferential region of said bucket body circumferential flange and interrupts said flange is pivotable relative thereto such that said edge remote from said pivot axis moves away from said bucket body out of a locking and lid latching position in which said tab is aligned with said bucket body circumferential flange into a lid lift-off position, characterised in that said tab is connected pivotably about said pivot axis which is approximately perpendicular to or inclined at an acute angle to the horizontal plane of the lid, to said circumferential end edge of the bucket body circumferential flange or to said bucket body and that said tab is provided at an inner longitudinal edge which is at least partially covered by said circumferential lid rim with a cam track which comes into operative relationship with said free end edge of said circumferential lid rim upon pivotal movement of said tab.

2. A pot-shaped vessel as set forth in claim 1 characterised in that said pivot axis is inclined with respect to the substantially horizontal plane of the lid in the direction of one and/or other mutually perpendicular horizontal axes.

3. A pot-shaped vessel as set forth in claim 1 characterised in that said tab is mounted pivotably at a spacing from and on said bucket body.

4. A pot-shaped vessel as set forth in claim 1 characterised in that said pivot axis is formed by a film hinge between said tab and said bucket body circumferential flange or said tab and said bucket body.

5. A pot-shaped vessel as set forth in claim 4 characterised in that said tab is provided at its one end region towards the bucket body with a curvature whose end edge goes into said film hinge.

6. A pot-shaped vessel as set forth in claim 4 characterised in that said tab is separated with its two free end edges by a narrow gap from the oppositely disposed circumferential end edges of said bucket body circumferential flange and that formed on a region of said tab, which is asymmetrical in the longitudinal direction, is a pivot leg having an end edge, said pivot leg which projects at an angle and said end edge goes into said film hinge.

7. A pot-shaped vessel as set forth in claim 1 characterised in that said pivot axis is formed by a film hinge between said tab and a mounting support formed on the bucket body.

8. A pot-shaped vessel as set forth in claim 7 characterised in that said tab is provided on its inside with a stiffening means connected to said mounting support by way of said film hinge.

9. A pot-shaped vessel as set forth in claim 7 characterised in that said mounting support is in the form of mounting legs arranged in a triangular or trapezoidal configuration when viewed from below and projecting from the circumference of said bucket body.

10. A pot-shaped vessel as set forth in claim 1 characterised in that said pivot axis is provided in an end region constituting said tab in the form of a two-armed lever.

11. A pot-shaped vessel as set forth in claim 1 characterised in that provided between at least one of the regions of the tab and said circumferential flange is an anti-tamper safeguard which can be torn away or which is latchable or deformable.

12. A pot-shaped vessel as set forth in claim 1 characterised in that the longitudinal edge of said tab, which is provided with the cam track, is connected in such a way that it can be torn away by way of legs or a film to the respective adjacent longitudinal edge which delimits a cut-out accommodating said tab.

13. A pot-shaped vessel as set forth in claim 12 characterised in that said legs or said film is or are provided in a region which is remote from said pivot axis and which is exposed with respect to said lid rim, between said cam track of said tab and the longitudinal edge of said bucket body circumferential flange.

14. A pot-shaped vessel as set forth in claim 5 characterised in that there is provided at least one latchable or deformable projection on said tab, which projection upon movement from an originally closed condition of the vessel into the condition in which said vessel has been opened for the first time, ilTeversibly changes the condition of engagement of said projection with respect to a stationary projection or region.

15. A pot-shaped vessel as set forth in claim 5 characterised in that said latchable or deformable projection is formed in said curvature region of said tab or in the region of the end of said tab which is remote from a gripping portion.

16. A pot-shaped vessel as set forth in claim 6 characterised in that said tab has a gripping portion which is adapted to be bendable with respect to the main region of the tab.

17. A pot-shaped vessel as set forth in claim 11 characterised in that said anti-tamper safeguard is formed by a latching clip which upon pivotal movement of said tab passes into a visible latched pivoted-out position.

18. A pot-shaped vessel as set forth in claim 17 characterised in that said pivotable latching clip has a pivot axis substantially parallel to said pivot axis of said tab.

19. A pot-shaped vessel as set forth in claim 17 characterised in that said latching clip is of substantially T-shaped or hammer-like configuration in cross-section, wherein the free end of the base leg of the clip forms said pivot axis and wherein said base leg is covered by two clip limbs and at least one of said clip limbs is provided with a latch.

20. A pot-shaped vessel as set forth in claim 19 characterised in that said latching clip pivot axis is formed by a film hinge formed between the end of the base leg of the clip and a free end of a mounting leg formed on the mounting support.

21. A pot-shaped vessel as set forth in claim 20 characterised in that said mounting leg extends parallel to the periphery of said bucket body.

22. A pot-shaped vessel as set forth in claim 19 characterised in that said latching clip in the pivoted-out position is latchable to a support leg between the inside of said bucket body circumferential flange and the outside circumference of the bucket body.

23. A pot-shaped vessel as set forth in claim 22 characterised in that the clip limb on the outside and the support leg at its side face towards said latching clip are provided with parallel latching ribs.

24. A pot-shaped vessel as set forth in claim 17 characterised in that in the starting position said latching clip is affanged with its outside within a gap arranged between a circumferential edge of said bucket body circumferential flange and a tab edge adjacent to said pivot axis of said tab.

25. A pot-shaped vessel as set forth in claim 17 characterised in that said tab is provided at a short lever arm with an actuating edge for pivotal movement of said latching clip.

26. A pot-shaped vessel as set forth in claim 25 characterised in that said actuating edge of said tab engages said short lever arm of said latching clip and/or said base leg thereof.

27. A pot-shaped vessel as set forth in claim 19 characterised in that said clip limbs extend in a curved configuration.

28. pot-shaped vessel as set forth in claim 1 characterised in that said cam track towards said pivot axis extends as far as an upper edge of the body.

29. A pot-shaped vessel as set forth in claim 1 characterised in that said tab is increased in thickness and/or is enlarged in gripping area in a region outside the area of overlap by said lid circumferential edge.

30. A pot-shaped vessel as set forth in claim 1 characterised in that in a starting position said tab bears at a free gripping surface end at the inside against an adjacent support leg projecting from the periphery of the bucket body.

* * * * *

UNITED STATES PATENT AND TRADEMARK OFFICE

CERTIFICATE OF CORRECTION

PATENT NO. : 7,475,789 B2
APPLICATION NO. : 10/522641
DATED : January 13, 2009
INVENTOR(S) : Ronald Fischer It is certified that error appears in the above-identified patent and that said Letters Patent is hereby corrected as shown below:

On the title page, item (73), under "Assignee", in column 1, line 2, delete "Wippwefurth" and insert -- Wipperfurth --, therefor.

In column 11, line(s) 52-53, in Claim 14, delete "ilTeversibly" and insert -- irreversibly --, therefor.

In column 12, line 35, in Claim 24, delete "affanged" and insert -- arranged --, therefor.

In column 12, line 46, in Claim 28, before "pot-shaped" insert -- A --.

Signed and Sealed this

Twenty-sixth Day of May, 2009

John Doll

JOHN DOLL
*Acting Director of the United States Patent and Trademark Office*